US005803790A

United States Patent [19]

Tilbor et al.

[11] Patent Number: 5,803,790

[45] Date of Patent: Sep. 8, 1998

[54] TOY VEHICLE WITH SELECTIVELY POSITIONABLE WING

[75] Inventors: Neil Tilbor; Michael G. Hetman, both of New Smyrna Beach, Fla.; Anthony R. Garr, Voorhees, N.J.

[73] Assignee: Mattel, Inc., Mount Laurel, N.J.

[21] Appl. No.: 785,404

[22] Filed: Jan. 22, 1997

[51] Int. Cl.[6] ..... A63H 17/00; A63H 29/00

[52] U.S. Cl. ..... 446/470; 446/436; 446/443; 446/465

[58] Field of Search ..... 446/273, 274, 446/288, 436, 437, 439, 443, 448, 450–453, 457, 458, 465, 470

[56] References Cited

U.S. PATENT DOCUMENTS

| | | | |
|---|---|---|---|
| Re. 30,299 | 6/1980 | Greenwood . | |
| 2,175,845 | 10/1939 | Lohr . | |
| 2,247,354 | 7/1941 | Berger | 446/443 |
| 3,702,037 | 11/1972 | Toy et al. . | |
| 3,708,913 | 1/1973 | Terzian et al. . | |
| 3,772,824 | 11/1973 | Terzian et al. | 446/437 |
| 4,300,308 | 11/1981 | Ikeda | 446/457 |
| 4,329,810 | 5/1982 | Terui | 446/457 |
| 4,363,187 | 12/1982 | Shinohara | 446/437 |
| 4,438,589 | 3/1984 | Matsushiro | 446/456 |
| 4,449,323 | 5/1984 | Fisher . | |
| 4,457,101 | 7/1984 | Matsushiro | 446/456 |
| 4,477,999 | 10/1984 | Harigai et al. . | |
| 4,480,401 | 11/1984 | Matsushiro . | |
| 4,493,672 | 1/1985 | Terui | 446/464 |
| 4,508,516 | 4/1985 | D'Andrade et al. | 446/443 |
| 4,568,309 | 2/1986 | Maxim et al. . | |
| 4,580,994 | 4/1986 | Fauser et al. | 446/465 |
| 4,597,744 | 7/1986 | Rehkemper et al. | 446/278 |
| 4,680,021 | 7/1987 | Maxim | 446/457 |
| 4,715,602 | 12/1987 | May et al. . | |
| 4,850,931 | 7/1989 | Auer . | |
| 5,135,427 | 8/1992 | Suto et al. . | |
| 5,173,073 | 12/1992 | Franzone | 446/465 |
| 5,334,078 | 8/1994 | Hippely et al. | 446/470 |
| 5,487,692 | 1/1996 | Mowrer et al. . | |
| 5,643,036 | 7/1997 | Liu et al. . | |
| 5,667,420 | 9/1997 | Menow et al. . | |
| 5,667,421 | 9/1997 | Uetake | 446/470 |

*Primary Examiner*—Robert A. Hafer
*Assistant Examiner*—Laura Fossum
*Attorney, Agent, or Firm*—Panitch Schwarze Jacobs & Nadel, P.C.

[57] ABSTRACT

A toy vehicle includes a central vertical longitudinal plane at least one road-contacting front wheel coupled to the chassis to rotate about an axis fixed perpendicularly to the central plane and at least a pair of road-contacting rear wheels coupled to the chassis for rotation about a common rear rotational axis perpendicular to the central plane. Separate rear wheels of the pair are located on either lateral side of the chassis in the central plane. One or more motors are provided and coupled with the rear wheels to selectively drive the rear wheels at least simultaneously in either linear direction, forward or rearward, or simultaneously in opposite linear directions. A support member shaped like a wing is selectively positionable on the chassis and can be fixed in any of at least three different positions, a first position juxtaposed to the chassis, a second position extending generally vertically from the chassis permitting the vehicle to be stably supported upright on the support member and pair of rear wheels with the front wheels above the rear wheels and a third position extending to the rear of the rear wheels preventing the vehicle from being stably supported on only the wing and rear wheels. The vehicle components are arranged so that the rear wheels support at least two-thirds and preferably three-quarters or more the vehicle weight.

12 Claims, 4 Drawing Sheets

TOY VEHICLE WITH SELECTIVELY POSITIONABLE WING

BACKGROUND OF THE INVENTION

Both 4×4 and 6×4 radio-controlled toy vehicles are known in which the vehicle wheels define an envelope that fully surrounds the remainder of the vehicle. Such vehicles can be supported on a level surface only upon their wheels, regardless of their orientation. Such vehicles can be operated on either of two opposing major sides of the vehicles, which alternately define upper and lower sides of the vehicle. The known 6×4 radio-controlled toy vehicle in question can be stably supported and operated on any two of its three different adjoining pairs of 6 wheels.

Yet another radio-controlled toy vehicle is known which transforms itself under remote control by selectively moving various body components. In particular, a panel normally forming a section of the roof can be elevated from the roof and rotated rearwardly to form a wing extending off the rear end of the vehicle.

Yet another radio-controlled toy vehicle is known which includes a battery pack which can be shifted longitudinally in the vehicle to vary the longitudinal location of the vehicle center of gravity closer to or farther from the rear wheel to selectively enhance or retard the ability of the vehicle to perform a front wheel rise ("wheelie") maneuver.

Still another radio-controlled vehicle is known having a pair of chassis. An inner chassis with its own pair of propulsion treads is located within an outer, square, hollow chassis having a separate set of propulsion treads. The inner chassis can be made to rotate on the outer chassis by remote control from a position fully surrounded by the outer chassis to a position 180° outside the chassis and to any position in between.

BRIEF SUMMARY OF THE INVENTION

The invention is a toy vehicle comprising: a chassis having lateral sides and an imaginary central plane extending longitudinally and vertically through the chassis centered between the lateral sides; at least one road contacting front wheel coupled with the chassis for rotation about a front rotational axis fixed perpendicular to the central plane; at least a pair of road contacting rear wheels coupled to the chassis for rotation about a common rear rotational axis, separate perpendicular to the central plane rear wheels of the pair being located on either lateral side of the chassis and the central plane; motor means for selectively driving the rear wheels simultaneously in at least a first linear direction and simultaneously in opposite linear directions; and a support member selectively positionable on the chassis fixed in any of at least three different positions, a first position juxtaposed to the chassis, a second position extending generally vertically upward from the chassis above the pair of rear wheels and a third position extending generally rearwardly from the chassis and behind the pair of rear wheels; wherein the chassis, the support member and the road-contacting front and rear wheels are sized and positioned such that in the first position of the support member, the road-contacting front and rear wheels define an envelope fully surrounding the chassis and the support member such that only road-contacting wheels contact a planar surface supporting the vehicle in any possible orientation of the vehicle; wherein the support member is sized with respect to the vehicle and the second position is selected such that the vehicle is stably supported on a planar horizontal surface at rest on only the pair of road-contacting rear wheels and the support member with the at least one road-contacting front wheel located vertically directly above the rear wheels; and wherein the support member is located sufficiently behind the pair of road-contacting rear wheels in the third position that the vehicle cannot be stably supported on a horizontal planar surface at rest on only the pair of road-contacting rear wheels and the support member.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
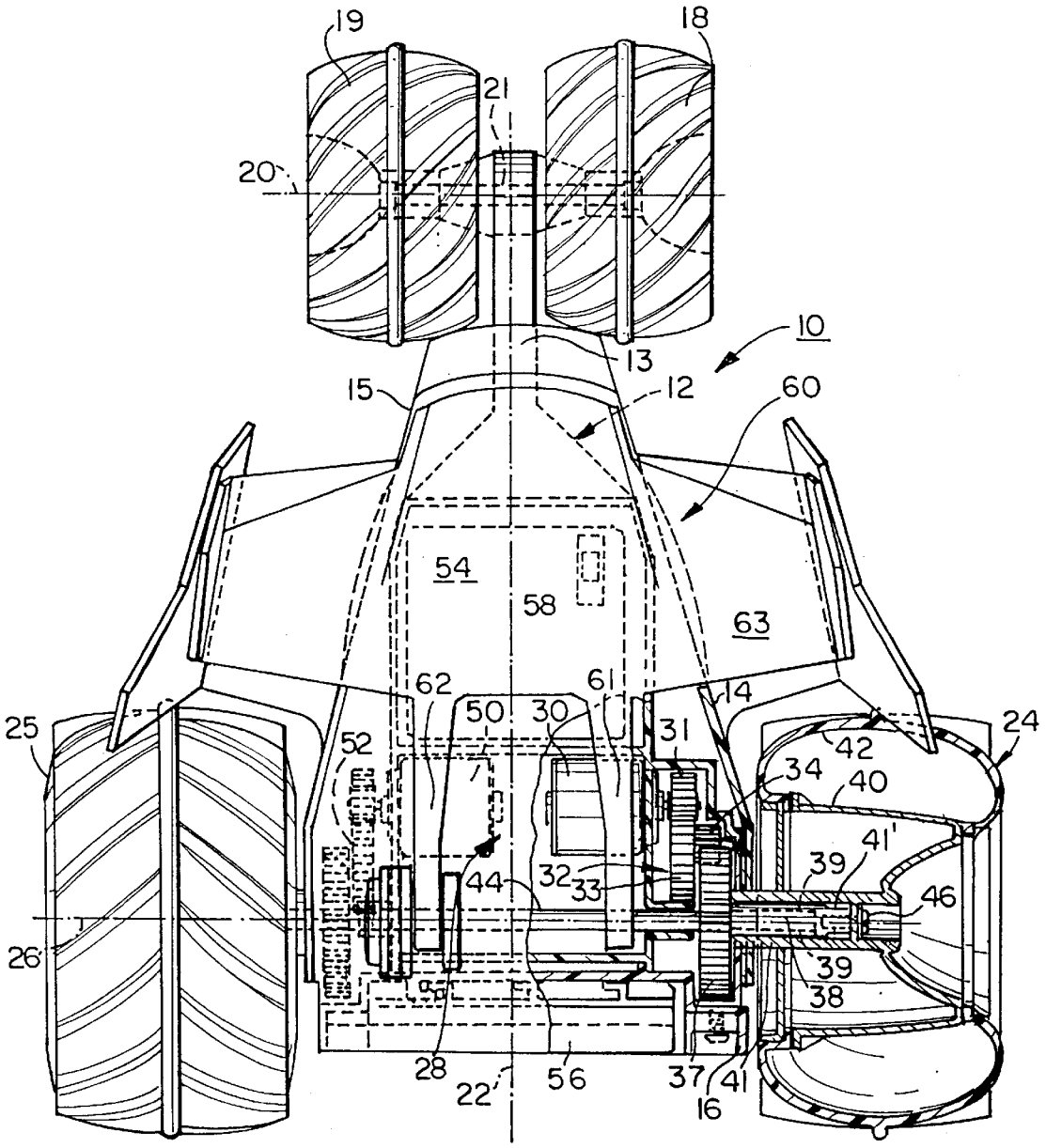
FIG. 1 is a partially broken away top view of a toy vehicle of the invention.
Figure 2:
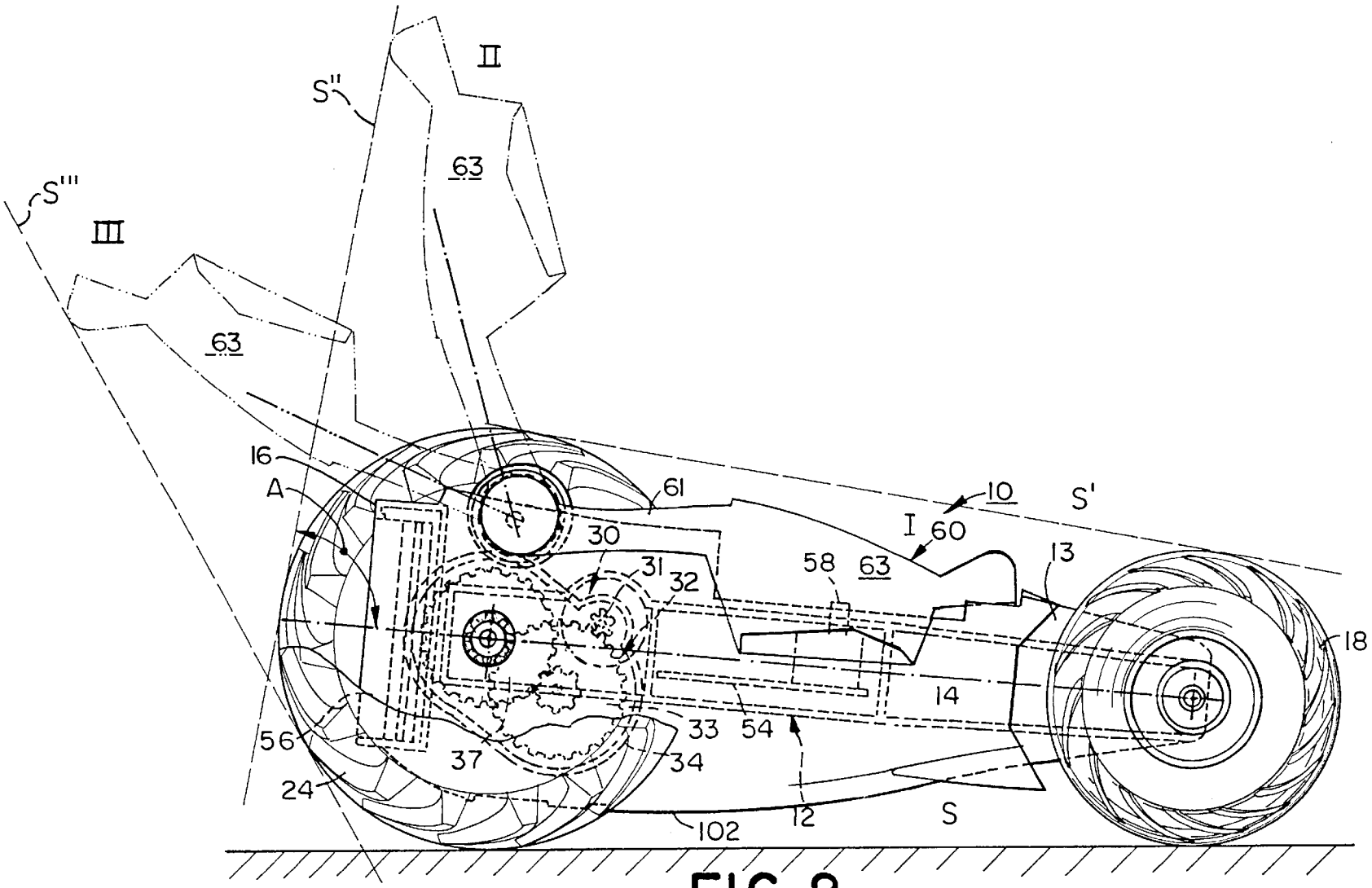
FIG. 2 is a partially broken away side elevation of the vehicle of FIG. 1.

In the drawings, like numerals are used to indicate like elements throughout. FIGS. 1 and 2 show a first embodiment toy vehicle of the present invention indicated generally at 10 and having opposing major sides 100, 102 (see FIG. 2). The vehicle includes a chassis indicated generally at 12 having a front 13 lateral sides 14 and 15 and a rear 16. At least one and preferably a pair of road-contacting front wheels 18 and 19 are coupled with the chassis 12 for rotation about a front rotational axis 20 which is fixed perpendicular to a central plane 22 which extends longitudinally and vertically through the chassis 12 centered between the lateral sides 14 and 15 and perpendicular to the plane of FIG. 1. Preferably, front wheels 18 and 19 are mounted for free independent rotation on an axle 21 (in phantom) the center of which is co-linear with the front rotational axis 20. At least a pair of road-contacting rear wheels 24, 25 are also coupled with the chassis 12 for rotation about a common rear rotational axis 26 also perpendicular to the central plane 22. The rear wheels 24 and 25 are located on either lateral side 14, 15, respectively of the chassis 12 and the central plane 22.

Motor means, indicated generally at 28 are mounted within the chassis 12 for selectively driving the rear wheels 24, 25 simultaneously in at least a first linear direction (forward or reverse) and, if desired, simultaneously in opposite linear directions. More specifically, motor means 28 is preferably provided by first and second reversible electric motors 30 and 50, respectively. Motors 30, 50, are also preferably located on opposite sides of the central plane 22. Each motor 30, 50, is preferably drivingly coupled only with the proximal rear wheel 24 or 25, respectively.

The coupling between first electric motor 30 and proximal rear wheel 24 is shown in detail in FIGS. 1 and 2. Motor 30 is drivingly coupled with rear wheel 24 through a reduction gear train indicated generally at 32. First motor 30 mounts a pinion 31 on its drive shaft. As is best seen in FIG. 2, the reduction gear train 32 comprises a first pair of joined idler gears 33, 34 and a final drive gear 37, which is engaged directly by the smaller idler gear 34. The outer lateral side of gear 37 supports a generally tubular sleeve 38 which can be passed through a journal (not depicted) and out the lateral side 14 of the chassis 12. Rear wheel 24 includes a rim 40 having a central hollow axial tube 41 receiving sleeve 38 and a mounted tire 42. Preferably, the sleeve 38 is provided with radially outwardly projecting keys 39 which are received in radial slots 41' provided in the central tube 41 of rim 40 to drivingly couple the sleeve 38 with the wheel 24. A sleeve bearing with key ways (not depicted) can be mounted on the keyed sleeve to permit smooth rotation of the sleeve in the journal. A metal rear axle 34 is preferably extended into the hollow center of the tubular collar 38 as a bearing, to maintain alignment and for strength. Wheel 24 is preferably secured to the tubular collar 38 by suitable means such as a machine screw 46. The second electric motor 50 is drivingly coupled with the remaining rear wheel 25 through a second reduction gear train 52, both indicated in phantom in FIG. 1. Second electric motor 50 and second reduction gear train 52 are mirror images of first motor 30 and gear train 32 with respect to central plane 22.

According to an important aspect of the invention, a support member 63, preferably in the general form of a wing, is selectively positionable on the chassis 12 in any of at least three different positions. Preferably wing or support member 63 is part of an assembly 60 which includes a pair of arms or struts 61 and 62 which are mirrors of each other with respect to the central plane 22 and which are pivotally attached at one end with the chassis 12 and which support at their remaining ends, the wing shaped 63. Wing 63 extends transversely to the longitudinal central plane 22 overlapping the lateral sides 14 and 15 of the vehicle and at least partially laterally overlapping the pair of rear wheels 24 and 25, as is indicated in FIG. 1.

Referring to FIG. 2, the wing 63 is indicated in a first position, in solid, juxtaposed to the chassis 12 on major side 100 of the vehicle 10. The wing is depicted in phantom in the second position indicated at II in which it extends generally vertically upward from the chassis 12 and above the pair of rear wheels 24 and 25. FIG. 2 further indicates the wing 63 in phantom in a third position at III in which it extends generally rearwardly from the chassis 12 preferably above and behind the pair of rear wheels 24, 25.

According to another important aspect of the invention, the chassis 12 wing 63 and road-contacting front and rear wheels 18, 19 and 24, 25 are sized and positioned such that in the first position of the wing shown in solid in FIGS. 1 and 2, juxtaposed to the chassis 12, the road-contacting front and rear wheels 18, 19 and 24, 25 define an envelope which fully surrounds the chassis 12 and wing 63 such that only the road contacting wheels 18, 19 and 24, 25 contact a planar surface S supporting the vehicle 10 in any possible orientation of the vehicle on that surface S, included full inversion of the vehicle 10 on surface S' (in phantom in FIG. 2).

According to a further important aspect of the invention, wing 63 is further sized with respect to the vehicle 10 and the second position II of the wing 63 is selected such that the vehicle 12 is stably supported at rest on a planar horizontal surface S" on only the pair of road-contacting rear wheels 24, 25 and the wing 63 with the road-contacting front wheel(s) 18, 19 located vertically directly above the rear wheels 24, 25. This can be seen by rotating FIG. 2 until line S" is horizontal simulating a horizontal support surface.

Finally, according to yet another important aspect of the invention, the wing 63 in the third position III is located sufficiently behind the pair of road-contacting rear wheels 24, 25 that the vehicle 10 cannot be stably supported at rest on a planar horizontal surface S'" extending tangentially from the wing 63 to the rear wheels 24, 25, on only the pair of road-contacting rear wheels 24, 25 and the wing 63. This is because the center of gravity of the vehicle in the third position on a horizontal surface S'" is located forward of the rear wheel axis 26, rather than directly over or behind that axis as in the second position. However, vehicle 10 preferably is powered sufficiently so that the front 13 of vehicle 10 can elevate in a "wheelie" orientation with both rear wheels 24, 25 and wing 63 in contact with support surface S" at least when the vehicle 10 is accelerated under full power.

With the wing 63 located in the first position, the vehicle 10 is operable with either the wing side 100 of the chassis up as depicted in FIGS. 1 and 2 or the opposite side 102 of the chassis up. Furthermore, by sizing the wheels and the chassis and wing so that the wheels fully surround the chassis 12 and wing 60 in the first position, the vehicle 10 can also be made to tumble while moving yet remain able to be driven. While there is a remote possibility that the vehicle 10 might come to rest on one of its opposing lateral sides, the rear motor 30 or 50 on that lateral side of the vehicle can be activated to cause the connected rear wheel to spin. This would tend to disrupt the balance of the vehicle 10 causing it to fall over on one or the other of its major sides making the vehicle 10 operable.

Also seen in one or both of FIGS. 1 and 2 are a PC board 54 (in phantom) which contains the circuitry of a radio receiver and of a motor controller coupled with the radio receiver. A removable battery power supply 56 (in phantom) is supported at the rear 16 of chassis 12. The controller portion of the PC board 54 selectively couples the battery power supply 56 in forward or reverse drive direction(s) with either motor 30, 50 in response to control signals received by the receiver from a remote control radio transmitter equipped handset (not depicted). Lastly, an on-off switch 58 (in phantom) disconnects the battery power supply 56 from the remainder of the electrical system to conserve battery power.

According to yet another important aspect of the invention, the more weighty components of the vehicle 10, namely the motors 30, 50, drive trains 32, 52 and battery power supply 56 are all located in the rear 16 of the chassis 12 clustered generally around the rear rotational axis 26 so that the center of gravity of the vehicle is located within the vehicle 10 along the central plane 22 longitudinally in line with or very close to the rear rotational axis 26. The combination of the chassis 12 and wing 63 being located within the perimeters of the wheels 18, 19 and 24, 25, the wing 63 being in the first position, combined with the relatively light weight of the front 13 of the vehicle 10 permits an operator to flip the vehicle 10 over so that either of its major sides 100, 102 is located on top, quickly and with almost no translational movement of the vehicle 10 itself simply by running both powered wheels 24, 25 in the same linear (forward) direction and abruptly reversing the linear direction of both powered wheels 24, 25.

To achieve this performance, the center of gravity of the vehicle is shifted sufficiently rearwardly so that at least two-thirds, more desirably at least three-quarters, and preferably about 80% or more of the total or gross vehicle weight, including any battery power supply 56 on the vehicle 10, is being supported by only the rear road-contacting wheels 24, 25 when both its front and rear road-contacting wheels 18, 19 and 24, 25 are on a planar horizontal support surface, like vehicle 10 on surface S in FIG. 2.

This relative static unweighting of the front wheels 18 and 19, even with the wing 63 located in the initial position juxtaposed to the chassis 12, permits vehicle 10 to be more easily turned on high friction/high traction surfaces. The described preferred embodiment vehicle 10 is capable of performing 360° spins about the center of its rear rotational axis 26 and rear road-contacting wheels 24, 25 in contact with a high friction/traction surface such as a rug. A low friction front tire helps reduce scrubbing friction.

By selectively positioning the slow friction front tire helps reduce scrubbing friction wing 63 in the second position II in FIG. 2, the vehicle 10 can be stood on end and moved while it is on end supported only by its pair of rear road-contacting wheels 24, 25 and a portion of the wing 63 contacting surface S". The vehicle 10 can be elevated to the on end position simply by accelerating the vehicle 10 in a forward direction sufficiently rapidly with the wing 63 in the second position II. In the upright, on-end position of the vehicle 10, the battery power supply 56 is located beneath the rear rotational axis 26, further stabilizing the vehicle 10 in the upright position. To assist the vehicle 10 to maintain itself in the upright position II, the tire 42 of each rear wheel 24 and 25 is hollow, is made from a relatively soft and resiliently flexible, preferably slightly elastic material such as a soft rubber, and is open to atmosphere so that the tires may partially collapse under load. In the upright position, the weight of the vehicle 10 being supported by the tires causes them to flatten over a relatively large area, thereby increasing the size of the base supporting vehicle 10 and improving the stability of the vehicle in the upright position. By appropriate control of the motors 30, 50 with the vehicle 10 in the upright position II, the vehicle 10 can be made to drive forward or reverse, turn to the left or right or even spin in place about an axis extending generally through the rear rotational axis 26 and front rotational axis 20 in the central plane 22. The vehicle 10 can also be made to "walk" by alternately activating on motors 30, 50 briefly causing the vehicle 10 to partially turn on one side, and then partially turn in an opposite direction, imitating a walk. In the second position, even if the vehicle falls over on its side or it top (side 100), one driven wheel will always be in contact with the planar supporting surface.

In the third position III the wing 63, the center of gravity of the vehicle is shifted even farther to the rear of the vehicle, further enhancing the ability of the vehicle to do a front wheel rise or wheel stand or "wheelie" maneuver. However, the wing 63 should be located in the third position III extending sufficiently far behind the vehicle 10 that the vehicle 10 is no longer stable in an upright position resting upon only the rear road-contacting wheels 24, 25 and wing 60 on a planar horizontal surface S'". This happens because the center of gravity which is located close to the rear rotational axis 26 is nevertheless located sufficiently forward of that rear rotational axis 26, that it causes the front end of vehicle 10 to drop.

Preferably, the front wheels 18, 19 are also hollow, open to atmosphere and made from a soft rubber or other soft elastomeric material to cushion the front end when the vehicle 10 is made to flip over.

Referring again to FIG. 1 depiction of the preferred embodiment vehicle 10, the maximum vehicle width is at the rear of the vehicle between the lateral outer sides of the rear road-contacting wheels 24 and 25 and is nearly as great (e.g. about 10 inches) as the length of the vehicle (e.g. about 11 inches) from the rear surfaces of the rear road-contacting wheels to the front surfaces of the front road-contacting wheels.

As is further depicted in FIG. 2 when the wing 63 is located in the second position II, a center line 27 through the front rotational axis 20 and common rear rotational axis 26 intersects the horizontal planar surface S" supporting the vehicle 10 on the pair of rear wheels 24, 25 in the wing 60 in the second position II to define a greater angle and a lesser angle which together define a full 360° of arc. The lesser angle A includes the wing 63 and is between 80° and 100° in magnitude and, more desirably, between 80° and 90°, to locate the front end of the vehicle sufficiently directly over the rear wheels to maximize stability of the vehicle 10.

Figure 3:
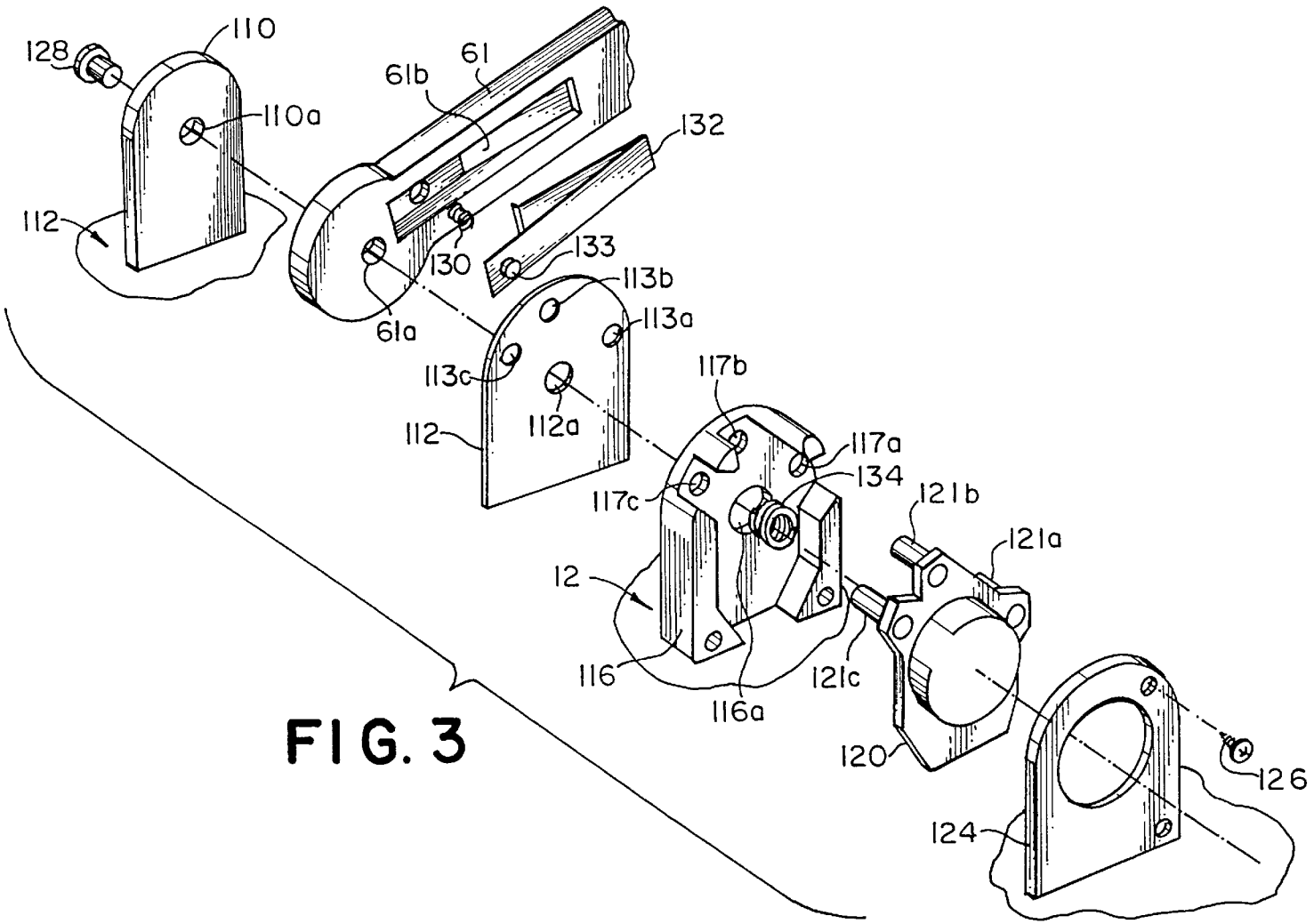
FIG. 3 is an exploded view of a first wing support latching mechanism.

FIG. 3 depicts diagrammatically in exploded form, one possible mounting of one arm 61 of the support assembly 60 to the chassis 12, for selective pivotal adjustment of the arm and the associated support member/wing 63. An inside stantion 110 is fixedly coupled with the chassis 12 on one side, an "inner" side of the arm 61. A preferably metal locating plate 112 is located on the other side of the arm between the arm and an outside stantion 116, also coupled with the chassis 12. A movable actuator plate 120 is secured to the outside stantion 116 by an outside cover plate 124 and fasteners 126 such as screws, which extend through holes in the outside cover plate 124 and into the outside stantion 116. A pivot axle 128 is secured to the inside stantion 110 by suitable means, such as being pressed fit through a central opening 110*a* through the stantion 110, through a similar pivot opening 61*a* of the arm 61, and central openings 112*a* through locating plate 112 and 116*a* through the outside stantion 116. A suitable recess 61*b* is provided in arm 61 to receive a compression spring 130 and leaf spring 132 with detent pin 133. Compression spring 130 biases the leaf bearing detent pin 133 outwardly against locating plate 112. Locating plate 112 is provided with three openings 113*a*–113*c* around central opening 112*a*. Outside stantion 116 is provided with similarly positioned openings 117*a*–*c*. Actuator plate 120 is provided with three projecting pins 121*a*–121*c* which are similarly positioned to align with and pass through openings 117*a*–*c* and 113*a*–*c*, respectively. Another compression spring 134 is located between the actuator plate 120 and preferably one of the outer stantion 116 and the locating plate 112 to bias actuator plate 120 against outside cover plate 124 and away from detent pin 133 when it is located in any of the openings 117*a*–*c*/113*a*–*c*. Pin 121*a* and openings 117*a* and 113*a* correspond to the location of the arm 61 and support assembly 60 in the first position where wing 63 is juxtaposed to the chassis 12. Pin 121*b* and openings 117*b* and 113*b* correspond to the second position II of the support assembly 60, wing 63 and arm 61. Pin 121*c* and openings 117*c* and 113*c* correspond to the third position III of the support assembly 60, wing 63 and arm 61.

The arm 61 is fixed in any of the three positions by engagement of the detent pin 133 with a set of the openings 113*a*–117*a*, 113*b*–117*b* or 113*c*–117*c*. When it is desired to re-position the support structure 60, wing 63 and arm 61, actuator plate 120 is manually pushed towards the arm 61 such that pins 121*a*–121*c* enter openings 117*a*–117*c* and 113*a*–113*c*, dislodging the detent pin 133 from any opening in which it may have been secured thereby freeing the arm 61. The arm can be moved to any adjoining position. Preferably, a mirror image coupling is provided between the second arm 62 and the chassis 12.

Figure 4:
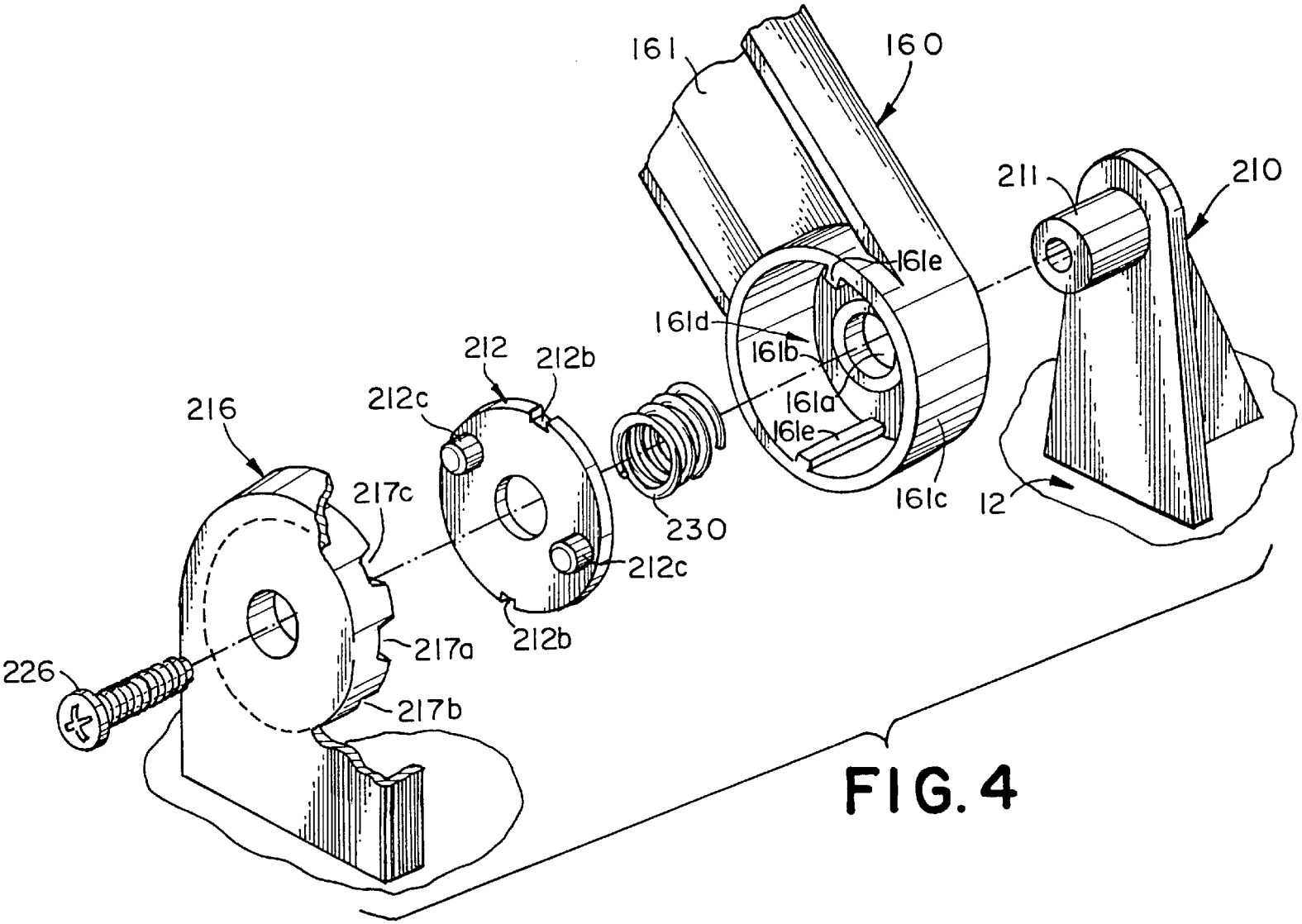
FIG. 4 is an exploded view of an alternative wing support latching mechanism.

FIG. 4 depicts an alternate pivotal support of an arm 161 of a support assembly 160 which does not require a separate actuator to move the arm among the at least three possible positions of the assembly 60 and its wing/support member 63. An inside stantion 210 is fixed with the chassis 12. A tubular screw boss 211 projects laterally from the stantion

210 and through a pivot opening 161*a* of the arm. Arm 161 includes a cylindrical recess 161*b* centered with respect to the central opening 161*a* and a transversely projecting annular flange 161*c* which together with the recess 161*b* define a generally cylindrical chamber 161*d*. The open end of the chamber is covered by an outside stantion 216 which is secured to the inside stantion by screw 226. Captured within the chamber 161*d* is a detent plate 212. The detent plate 212 is keyed with the inside wall of the chamber 161*d* by suitable means such as one or more keys 161*e* projecting radially inward into the chamber 161*d* which mate with a like number of key holes 212*b* on the detent plate 212 to permit the plate 212 to move, without rotating in cylindrical chamber 161*d*, towards and away from the outside stantion 216. The detent plate 212 is biased towards the outside stantion 216 by a compression spring 230. At least one and preferably at least a diametrically opposed pair of detents 212*c* project outwardly from the plate 212 towards the outside stantion 216. The detents 212*c* align with any of at least three diametrically positioned pairs of recesses 217*a*–217*c* provided on an inner surface of outside stantion 216 facing the detent plate 212 and the detents 212*c*. Each recess 217*a*–217*c* tapers down as it projects away from the detent plate 216 and into the stantion 216. The opposing transverse walls defining the taper permit the detents 212*c* to cam up and out of any engaged pair of recesses 217*a*–217*c* and force the detent plate 212 away from the outside stantion 216 when sufficient torque is applied to the arm 161. In this way, the mechanism fixedly engages the assembly 160 in any of the three predetermined positions but is self-camming for release and re-positioning simply by moving the support assembly 160 in the appropriate direction with sufficient force.

A radio-control system, which may be used with respect to the vehicle 10, is disclosed in U.S. Pat. No. 5,135,427, which is incorporated by reference herein. While separate motors independently driving rear wheels on either side of the vehicle 10 are disclosed, single and twin motor designs are known which permit selective forward or reverse driving of the road wheels on opposing lateral sides of the vehicle through a single transmission coupled with the motor or motors and both wheels. While radio control is preferred other forms of wireless controls particularly light and sound are known and can be used in place of radio controls. Also, hard wire control can be used, although not desired, and internal self-control e.g., so-called "cam-o-matic" drives can be employed, which mechanically programs the operation of the vehicle, as well as the newer, electronically programmed drives.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy vehicle comprising:

a chassis having lateral sides and an imaginary central plane extending longitudinally and vertically through the chassis centered between the lateral sides;

at least one road-contacting front wheel coupled with the chassis for rotation about a front rotational axis fixed perpendicular to the central plane;

at least a pair of road-contacting rear wheels coupled with the chassis for rotation about a common rear rotational axis perpendicular to the central plane, separate rear wheels of the pair being located on either lateral side of the chassis and the central plane;

motor means for selectively driving the rear wheels simultaneously in at least a first linear direction and simultaneously in opposite linear directions; and a support member selectively positionable on the chassis fixed in any of at least three different positions, a first position juxtaposed to the chassis, a second position extending generally vertically upward from the chassis above the pair of rear wheels and a third position extending generally rearwardly from the chassis and behind the pair of rear wheels;

wherein the chassis, the support member and the road-contacting front and rear wheels are sized and positioned such that in the first position of the support member, the road-contacting front and rear wheels define an envelope fully surrounding the chassis and the support member such that only road-contacting wheels contact a planar surface supporting the vehicle in any possible orientation of the vehicle;

wherein the support member is sized with respect to the vehicle and the second position is selected such that the vehicle is stably supported at rest on a planar horizontal surface on only the pair of road-contacting rear wheels and the support member with the at least one road-contacting front wheel located vertically directly above the rear wheels; and wherein the support member is located sufficiently behind the pair of road-contacting rear wheels in the third position that the vehicle cannot be stably supported at rest on a planar horizontal surface on only the pair of road-contacting rear wheels and the support member.

2. The toy vehicle of claim 1 wherein a center line through the front rotational axis and the common rear rotational axis intersects with a horizontal planar surface supporting the vehicle on the pair of rear wheels and the wing in the second position to define a lesser angle and a greater angle together defining a full 360° of arc, the lesser angle including the support member and being between 80° and 100° in magnitude.

3. The toy vehicle of claim 2 wherein the lesser angle has a magnitude of between 80° and 90°.

4. The toy vehicle of claim 1 further comprising a battery power supply mounted to the chassis behind the common rear rotational axis.

5. The toy vehicle of claim 4 having a gross vehicle weight and wherein at least two-thirds of the gross vehicle weight is supported on the rear road-contacting wheels with the vehicle supported at rest by only the front and rear road-contacting wheels on a horizontal planar support surface.

6. The toy vehicle of claim 5 wherein at least three-quarters of the gross vehicle weight is supported by the rear road-contacting wheels with the vehicle supported at rest by only the front and rear road-contacting wheels on the horizontal planar support surface.

7. The toy vehicle of claim 1 having a gross vehicle weight and wherein at least two-thirds of the gross vehicle weight is supported on the rear road-contacting wheels with the vehicle supported at rest by only the front and rear road-contacting wheels on a horizontal planar support surface.

8. The toy vehicle of claim 7 wherein at least three-quarters of the gross vehicle weight is supported by the rear road-contacting wheels with the vehicle supported at rest by only the front and rear road-contacting wheels on the horizontal planar support surface.

9. The toy vehicle of claim 1 wherein the motor means comprises:

a first motor drivingly coupled with only road-contacting wheels on one of the lateral sides of the vehicle; and a second motor drivingly coupled with only road-contacting wheels on a remaining one of the lateral sides of the vehicle.

10. The toy vehicle of claim 1 wherein the support member comprises a wing extending transversely to the imaginary central plane, the wing at least partially overlapping lateral sides of the chassis and at least partially laterally overlapping the pair of rear wheels.

11. The toy vehicle of claim 1 wherein each road-contacting rear wheel has a soft, resiliently flexible, road-contacting outer surface and is open to atmosphere so as to partially collapse under load.

12. The toy vehicle of claim 1 wherein each road-contacting front wheel has a soft, resiliently flexible, road-contacting outer surface and is open to atmosphere so as to partially collapse under load.

* * * * *